US009701461B2

(12) United States Patent
Garner et al.

(10) Patent No.: US 9,701,461 B2
(45) **Date of Patent: *Jul. 11, 2017**

(54) PACKAGES AND METHODS OF PACKAGING GLASS SHEETS

(71) Applicant: Corning Incorporated, Corning, NY (US)

(72) Inventors: Sean Matthew Garner, Elmira, NY (US); Jeffrey Allen Miller, Elmira, NY (US)

(73) Assignee: Corning Incorporated, Corning, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/073,280

(22) Filed: Mar. 17, 2016

(65) Prior Publication Data

US 2016/0207694 A1 Jul. 21, 2016

Related U.S. Application Data

(62) Division of application No. 13/988,636, filed as application No. PCT/US2011/062552 on Nov. 30, 2011, now Pat. No. 9,321,574.

(Continued)

(51) Int. Cl.

*B65D 85/48* (2006.01)
*B65B 61/22* (2006.01)

(Continued)

(52) U.S. Cl.

CPC ..... *B65D 85/48* (2013.01); *B65B 5/06* (2013.01); *B65B 23/20* (2013.01); *B65B 35/50* (2013.01);

(Continued)

(58) Field of Classification Search

CPC ..... B65D 85/48; B65D 75/00; B65D 81/02; B65D 81/127; B65B 5/06; B65B 23/20; B65B 35/50; B65B 61/22

(Continued)

(56) References Cited

U.S. PATENT DOCUMENTS 3,939,978 A 2/1976 Thomaswick
5,644,898 A 7/1997 Shepherd et al.

(Continued)

FOREIGN PATENT DOCUMENTS

CN 1956899 A 5/2007
CN 101687690 A 3/2010

(Continued)

*Primary Examiner* — Chun Cheung

(74) *Attorney, Agent, or Firm* — Jeffrey A. Schmidt

(57) ABSTRACT

Packages and methods of packaging a plurality of glass sheets provide a stack of glass sheets with an interleaf protective sheet positioned between each adjacent pair of glass sheets. An outer portion of each interleaf protective sheet is bent over a portion of the peripheral edge of one of a corresponding adjacent pair of glass sheets to discourage relative shifting of the glass sheets with respect to one another. The stack of glass sheets are sandwiched between pressure members of an outer housing such that the pressure members each apply a support pressure that is distributed over an outer surface of a corresponding one of the pair of outermost glass sheets of the stack of glass sheets.

19 Claims, 4 Drawing Sheets

Related U.S. Application Data

(60) Provisional application No. 61/417,989, filed on Nov. 30, 2010.

(51) Int. Cl.

| | |
|---|---|
| ***B65B 23/20*** | (2006.01) |
| ***B65B 35/50*** | (2006.01) |
| ***B65D 81/127*** | (2006.01) |
| ***B65D 57/00*** | (2006.01) |
| ***B65B 5/06*** | (2006.01) |
| ***B65D 81/02*** | (2006.01) |

(52) U.S. Cl.
CPC ..... *B65B 61/22* (2013.01); *B65D 57/00* (2013.01); *B65D 81/02* (2013.01); *B65D 81/127* (2013.01)

(58) Field of Classification Search
USPC ..... 206/449, 448, 453, 454, 455, 710
See application file for complete search history.

(56) References Cited

U.S. PATENT DOCUMENTS

| | | | | |
|---|---|---|---|---|
| 6,286,684 | B1 | 9/2001 | Brooks et al. | |
| 6,533,123 | B1 | 3/2003 | Nakamura et al. | |
| 6,789,674 | B2 * | 9/2004 | Allison | B65D 85/48 206/448 |
| 7,533,771 | B2 * | 5/2009 | Allison | B65D 5/5028 206/448 |
| 8,240,473 | B2 * | 8/2012 | Van Patten | B65D 81/107 206/448 |
| 2004/0195142 | A1 | 10/2004 | Hayashi et al. | |
| 2005/0098473 | A1 | 5/2005 | Sheehan, Jr. | |
| 2005/0109651 | A1 | 5/2005 | Fujimori | |
| 2005/0194279 | A1 | 9/2005 | Coppola et al. | |
| 2006/0144392 | A1 | 7/2006 | Blau | |
| 2007/0131574 | A1 | 6/2007 | Aoki | |
| 2008/0164173 | A1 | 7/2008 | Savakus | |
| 2009/0308774 | A1 | 12/2009 | Kim et al. | |

FOREIGN PATENT DOCUMENTS

| | | | |
|---|---|---|---|
| JP | 2002362641 | A | 12/2002 |
| JP | 2004071859 | A | 3/2004 |
| JP | 2005-239242 | A | 9/2005 |
| JP | 2006168832 | A | 6/2006 |
| JP | 2007-115524 | A | 5/2007 |
| JP | 2009-298479 | A | 12/2009 |
| WO | 2009/084605 | A1 | 7/2009 |
| WO | 2011/086731 | A1 | 7/2011 |
| WO | 2012/099070 | A1 | 7/2012 |

* cited by examiner

PACKAGES AND METHODS OF PACKAGING GLASS SHEETS

CROSS-REFERENCE TO RELATED APPLICATIONS

This application is a divisional of and claims the benefit of priority to U.S. patent application Ser. No. 13/988,636, filed on May 21, 2013, which in turn, claims the benefit of priority of International Patent Application Serial No. PCT/US11/62552, filed on Nov. 30, 2011, which in turn, claims the benefit of priority to U.S. Provisional Patent Application Ser. No. 61/417,989, filed on Nov. 30, 2010, the contents of each of which are relied upon and incorporated herein by reference in their entireties.

TECHNICAL FIELD

The present disclosure relates to packages and methods of packaging, and more particularly to packages and methods of packaging a plurality of glass sheets.

BACKGROUND

Packaging is often used for shipping, handling and/or storage of a plurality of glass sheets. However, typical conventional packaging techniques may not be sufficient to protect the glass sheets from damage. As such, there is a need for new packages and methods of packaging to facilitate shipment, handling and/or storage without damaging the glass sheets.

SUMMARY

The following presents a simplified summary of the disclosure in order to provide a basic understanding of some example aspects described in the detailed description.

In one example aspect, a method of packaging a plurality of glass sheets comprising the step of (I) providing a plurality of glass sheets that each includes a thickness defined between two opposed outer surfaces of the glass sheet, and at least one peripheral edge defining an outer periphery of the glass sheet; (II) providing an outer housing including a first pressure member and a second pressure member; (III) stacking the plurality of glass sheets with an interleaf protective sheet positioned between a plurality of adjacent pairs of glass sheets to form a stack of glass sheets, wherein each interleaf protective sheet includes a sandwiched portion engaging facing outer surfaces of the corresponding pair of glass sheets and a outer portion that extends away from the sandwiched portion; (IV) bending the outer portion of a plurality of the interleaf protective sheets over a portion of the peripheral edge of one of the corresponding adjacent pair of glass sheets such that substantially all the edge surfaces of the glass sheets are protected by the bent portions of the interleaf protective sheets to discourage relative shifting of the glass sheets with respect to one another; and (V) sandwiching the stack of glass sheets between the pressure members of the outer housing such that the pressure members each applies a support pressure that is distributed over an outer surface of a corresponding one of the pair of outermost glass sheets of the stack of glass sheets. In certain examples of this aspect, a plurality of the glass sheets bear a coating on at least one of the opposed outer surfaces, and at least some of the adjacent pairs of the glass sheets are stacked against each other with the coating located therebetween but without an interleaf protective sheet positioned therebetween. In certain other examples of this aspect, an interleaf protection sheet is positioned between each adjacent pair of glass sheets. Still in other examples of this aspect, the outer portion of each interleaf protective sheet is bent over the peripheral edge of one of the corresponding adjacent pair of glass sheets.

In another example aspect, a package comprises an outer housing including a first pressure member and a second pressure member. The package further comprises a stack of glass sheets sandwiched between the pressure members, wherein each pressure member applies a support pressure that is distributed over a corresponding one of a pair of outermost glass sheets of the stack of glass sheets. Each glass sheet of the stack of glass sheets includes a thickness defined between two opposed outer surfaces of the glass sheet, and at least one peripheral edge defining an outer periphery of the glass sheet. The stack of glass sheets includes an interleaf protective sheet positioned between each adjacent pair of glass sheets in the stack. Each interleaf protective sheet includes a sandwiched portion engaging facing outer surfaces of the corresponding pair of glass sheets and an outer portion that extends away from the sandwiched portion. The outer portion of each interleaf protective sheet is bent over a portion of the peripheral edge of one of the corresponding adjacent pair of glass sheets to discourage relative shifting of the glass sheets with respect to one another.

In accordance with examples of the above aspects, the plurality of glass sheets are packaged such that a tensile stress at the peripheral edge is less than 200 MPa.

In accordance with further examples of the aspects, each of the plurality of glass sheets has a length and a width that are both greater than 50 mm.

In accordance with still further examples of the aspects, the thickness of each of the plurality of glass sheets is less than 300 μm.

In accordance with yet additional examples of the aspects, a protective layer is provided between a first one of the pair of outermost glass sheets and the first pressure member of the outer housing. In accordance with further examples of the above aspects, an outer protective sheet is positioned between a second one of the pair of outermost glass sheets and the second pressure member of the outer housing. For example the outer protective sheet can be positioned such that a first portion of the outer protective sheet engages the second outermost glass sheet and an outer portion of the outer protective sheet is bent over a portion of the peripheral edge of the second outermost glass sheet to discourage a shifting movement of the second outermost glass sheet within the stack of glass sheets. In still further examples, a substantially rigid pressure plate can be biased away from the second pressure member of the housing to apply support pressure distributed over the second outermost glass sheet.

In accordance with further examples of the aspects, a strap can be provided to bend the outer portion of each interleaf protective sheet. For example, the strap can extend over the stack of glass sheets and can be fixed to the first pressure member. In further examples of the aspects, the support pressure provided by each pressure member can be substantially the same and uniform across the entire corresponding outer surface.

In yet additional examples of the aspects, each interleaf protective sheet can comprise paper or plastic.

In further examples of the aspects, each of the plurality of glass sheets have substantially the same shape.

In still further examples of the aspects, each of the plurality of glass sheets can extend along a curved or flat plane. For example, each of the plurality of glass sheets can extend along a curved plane while each interleaf protective sheet is not continuous with the sandwiched portion of each interleaf protective sheet only extending between at least two edge portions, or all of the edge portions of the facing outer surfaces.

In additional examples of the aspects, the outer housing encapsulates an interior area, wherein the stack of glass sheets are mounted within the interior area of the housing.

In further examples of the aspects, the outer housing does not directly contact the peripheral edge of any of the glass sheets.

In yet further examples of the aspects, the corresponding peripheral edges of each of the plurality of glass sheets are aligned with one another in a direction perpendicular to the outer surfaces of the glass sheets.

In additional examples of the aspects, none of the interleaf protective sheets are adhered to any of the glass sheets.

In still further examples of the aspects, the housing comprises molded foam or plastic. In yet further examples of the aspects, the interleaf protective sheets are successively staggered with respect to one another in a direction of the stack of glass sheets such that the outer portion of the interleaf protective sheets have alternating widths with respect to the corresponding peripheral edge of the glass sheet.

In still further examples of the aspects, the glass sheets are secured such that the outer periphery of the glass sheets are not subjected to a compressive stress exerted by the side walls of the housing.

In still further examples of the aspects, the glass sheets are secured by at least one strap mounted over the top surface of the stack of glass sheets.

In still further examples of the aspects, the outer periphery of the glass sheets are not subjected to a compressive stress exerted by the straps.

BRIEF DESCRIPTION OF THE DRAWINGS

These and other aspects are better understood when the following detailed description is read with reference to the accompanying drawings, in which.

DETAILED DESCRIPTION

Figure 1:
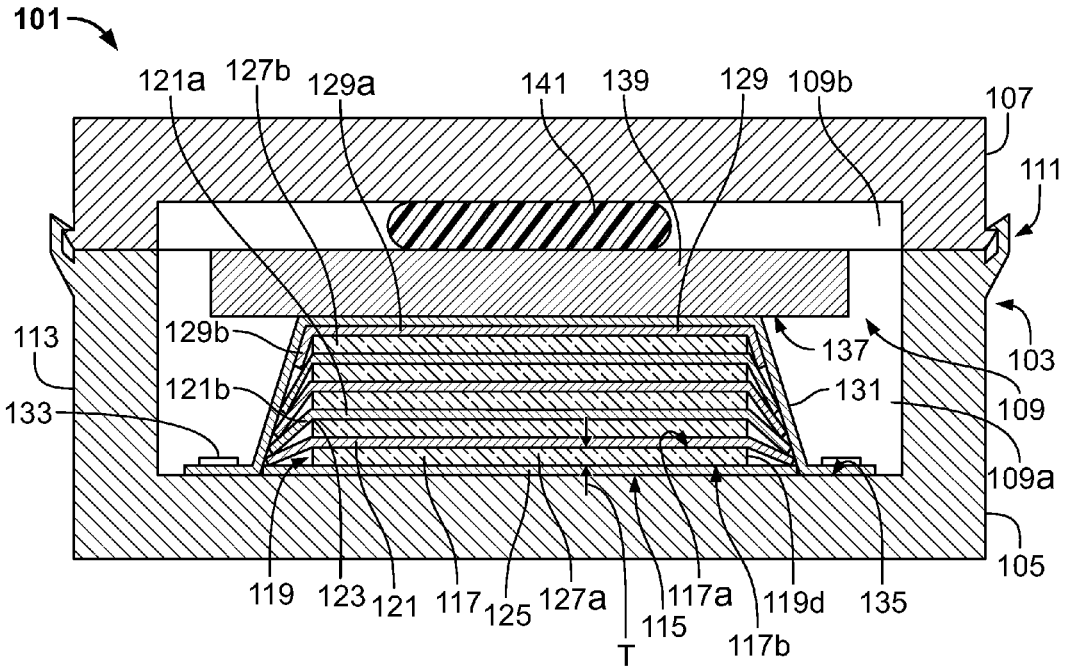
FIG. 1 is a cross sectional view one example package.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

FIG. 1 illustrates a package 101 including an outer housing 103 with a first pressure member 105 and a second pressure member 107. The outer housing 103 can comprise a wide range of materials such as molded foam or plastic although other materials may be used in further examples. The outer housing 103 can be constructed to insulate a plurality of housed glass sheets from surrounding environmental conditions such as vibrations, impact forces, thermal gradients, contamination or the like.

In one example, the outer housing 103 is configured to encapsulate an interior area 109. For instance, as shown, the first pressure member 105 may include a first interior portion 109*a* and the second pressure member 107 may comprise a second interior portion 109*b*. In such examples, the first and second pressure members 105,107 may be attached to one another such that the interior portions 109*a*, 109*b* form the interior area 109 encapsulated by the outer housing 103. Although not shown, one of the first and second pressure members 105, 107 simply comprise a lid with no interior portion. In such examples, the lid would close off the interior portion formed in the other pressure member to provide the encapsulated interior area. In still further examples, the first and second pressure members may cooperate with a third member to form the encapsulated area. For instance, the sidewall 113 of the outer housing 103 may be provided separately from the first and/or second pressure members 105, 107.

Although not shown, it is possible for the outer housing 103 to protect an interior area that is not encapsulated by the outer housing 103. For example, the sidewall 113 may not be provided in examples of the disclosure. Such examples may be desirable to reduce material necessary to produce the package. Such examples may be desirable, for example, when the package does not require lateral protection from surrounding environmental conditions or where the package is housed in another outer package that provides such lateral protection.

In some examples, the first and second pressure members 105,107 may be attached together. For example, as shown, the outer housing 103 may be provided with a snapping connection 111 although buckles, tape, straps, adhesives or other attachment mechanisms may be provided in further examples in order to attach the pressure members together.

As further illustrated, the package 101 includes a stack 115 of glass sheets 117 that are sandwiched between the first and second pressure members 105, 107 to facilitate mounting of the stack 115 within the interior area 109 of the outer housing 103. Glass sheets 117 can comprise glass, glass ceramic, and/or ceramic substrates. These glass sheets 117 can optionally include one or multiple organic and/or inorganic layers or structures on one or both of its two opposed outer surfaces 117*a*, 117*b*. Each glass sheet 117 of the stack 115 of glass sheets includes a thickness "T" defined between the two opposed outer surfaces 117*a*, 117*b* of the glass sheet 117. The package 101 can be used to package glass sheets having various thicknesses, either together or separately. Moreover, the package 101 is capable of effectively packaging glass sheets having a thickness "T" of less than or equal to 300 μm that may not be possible with other conventional packaging designs.

Figure 7:
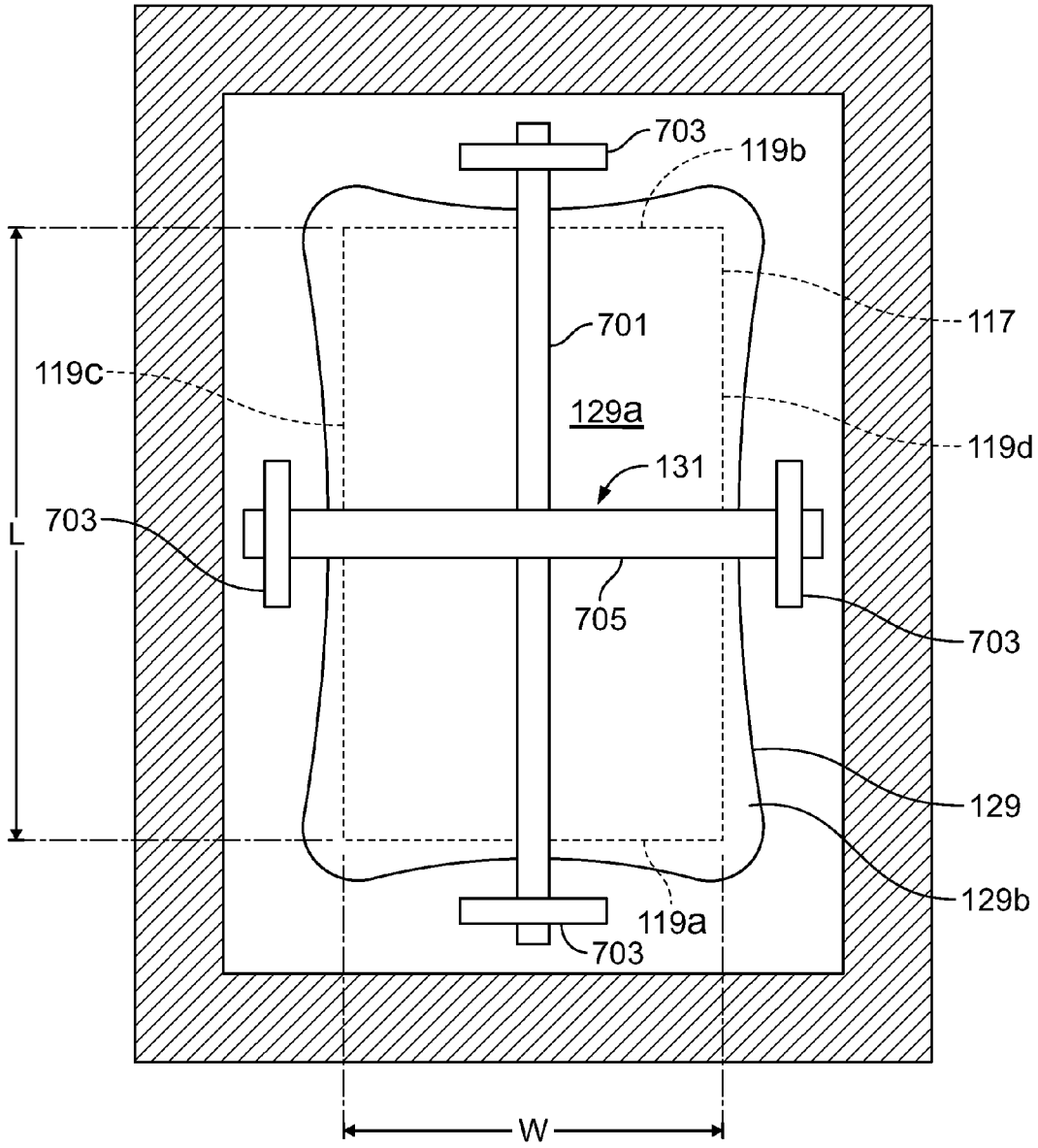
FIG. 7 is a sectional view along line 7-7 of FIG. 5.

Each glass sheet 117 further includes at least one peripheral edge 119 defining an outer periphery of the glass sheet 117. In one example, the glass sheet may include a single peripheral edge to form an outer periphery having the desired shape (e.g., circular, elliptical shape), two peripheral edges to form an outer periphery having other shapes (e.g., half circle) or three or more peripheral edges to form other desired shapes (e.g., polygonal shapes). For example, as apparent in hidden lines in FIG. 7, the at least one peripheral edge of the glass sheet 117 includes four edges 119*a-d* forming a rectangular shape although square or other shapes may be provided in further examples. The package 101 is capable of effectively packaging glass sheets having a wide range of lengths and widths. Moreover, as shown in FIG. 7, each of the plurality of sheets can have a length "L" and a width "W" that are both greater than or equal to 50 mm. In further examples, the length "L"×"W" can range from 120 mm×100 mm up to 370 mm×250 mm although other length/width dimensions (e.g., 1 m×1 m) may be provided in further examples. In further examples, package 101 can effectively package a plurality of glass sheets 117 that have a thickness "T" of less than or equal to 300 μm and a length "L" and width "W" of greater than or equal to 50 mm.

The glass sheets in the package can have a wide variety of shapes that are identical or different from one another. For example, as shown in FIG. 1, the glass sheets 117 all have substantially the same shape and extend along a flat plane. Indeed, the glass sheets 117 comprise substantially flat glass sheets with opposed outer surfaces 117*a*, 117*b* that are substantially planar and parallel from one another.

In another example, the glass sheets in the package can also vary in length "L" and/or width "W" or other dimensions, wherein the stack of glass sheets form a tiered configuration with glass dimensions that are successively smaller than one another in the direction of the stack. For example, if provided as rectangular shapes, the sheets may be geometrically similar to one another but successively smaller in the direction of the stack to form a truncated pyramid shape when stacked together. In this way, no individual glass sheet would have a cantilevered portion or extend beyond any glass sheet positioned lower in the stack.

Figure 2:
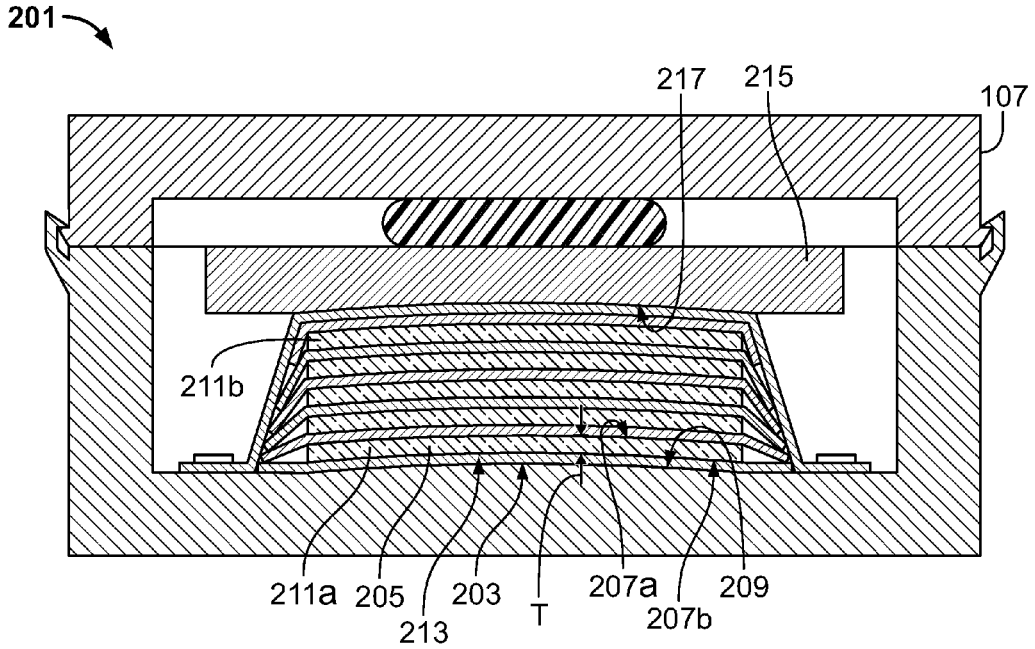
FIG. 2 is a cross sectional view of another example package.
Figure 6:
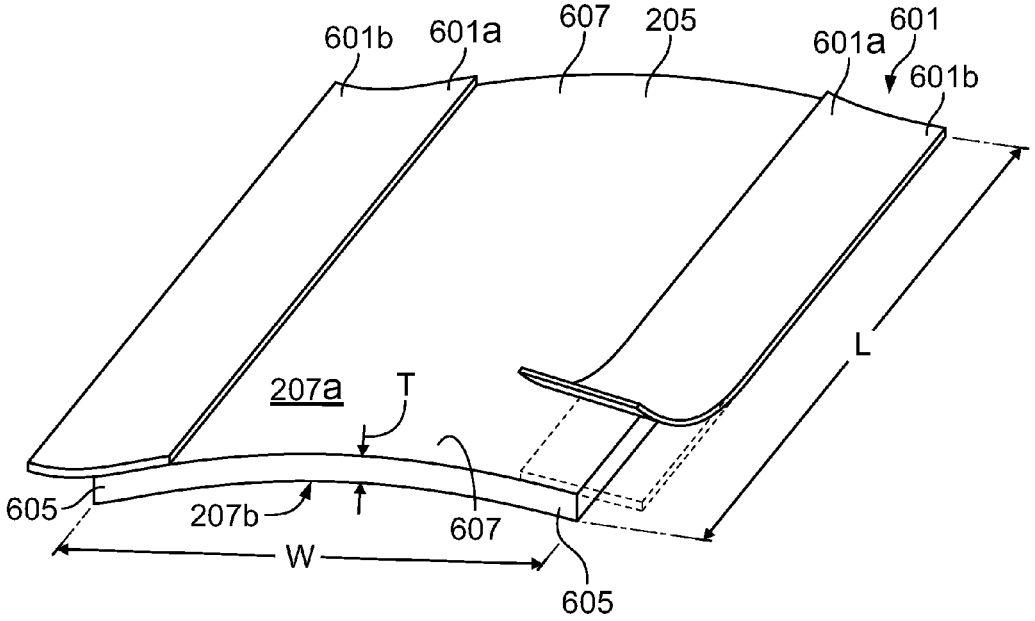
FIG. 6 is an example interleaf protective sheet positioned with respect to a curved glass sheet.

The glass sheets can include other shapes in further examples. For instance, as shown in FIG. 2, a package 201 includes a stack 203 of glass sheets 205 that are substantially the same shape and extend along a curved plane. Indeed, as shown in FIG. 6, the glass sheets 205 can have a cross section along the width "W" that is substantially curved such that the opposed outer surfaces 207*a*, 207*b* are curved with the first outer surface 207*a* having an upwardly convex shape and the second outer surface 207*b* having a downwardly concave shape. Although not shown, the glass sheets 205 can also have a cross section along the width "W" that is substantially curved such that the opposed outer surfaces 207*a*, 207*b* are also curved but the first outer surface 207*a* has upwardly concave shape and the second outer surface 207*b* has a downwardly convex shape (i.e., flipped over from the position illustrated in FIG. 6).

Turning back to FIG. 1, the stack 115 of glass sheets 117 includes an interleaf protective sheet 121 positioned between each adjacent pair of glass sheets 117 in the stack 115. The interleaf protective sheet 121 can comprise a wide range of materials designed to protect adjacent glass sheets from damaging one another. The interleaf protective sheet 121 can be designed to minimize surface contact damage or surface contamination that may be caused by other glass sheets 117 or the interleaf protective sheet 121 itself. In one example, the protective sheet comprises paper or plastic (e.g., plastic film or sheet) designed to protect the respective glass sheet. In addition, the protective sheet can be comprised of a material with reduced fiber shedding during shipping. Thus, after unpacking the stack of glass sheets, little or no residual debris or other surface contamination is left on the glass sheet that would otherwise require further or extensive cleaning procedures. In some examples, clean room paper may be used as the interleaf protective sheet. Clean room paper can provide the desired protection while providing minimal, if any, shedding of paper fibers when unpacking the glass sheets.

In further examples, the interleaf protective sheet 121 can comprise a glassine paper as set forth in U.S. Patent Application Publication No. 2009/0308774 that is herein incorporated by reference in its entirety. Glassine paper can be defined as super-calendared paper manufactured principally from chemically-bleached wood pulps that have been beaten to secure a high degree of stock hydration. Glassine paper is generally grease resistant. Glassine paper is dense, which results in a paper having a high resistance to the passage of air and relatively impervious to the passage of water vapor when compared to other paper products. It is also smooth and transparent or semi-transparent. Glassine paper generally has a low inorganic content, which is generally present in other types of paper. Due to the lack of fillers, binders, resins and other additives, any organic contaminants are minimized, and stain formation on the glass surface is prevented. Inorganic contaminants present in the paper are generally locked within the paper by processing, which prevents subsequent scratching of the glass surface. Glassine paper can be manufactured so that is it translucent, white, or colored, and may also be made opaque by the addition of fillers.

The interleaf protective sheets can be loosely or strongly adhered to one or both of the corresponding pair of glass sheets in the stack. Adhesion can be produced by covalent bonding, adhesives and/or electrostatics. In one example, a plastic film may be adhered to one side of the glass sheet. After unpacking, the film may be pealed off of the glass sheet. Such a design may be desirable to help prevent shifting of the interleaf protective sheets after formation of the stack. In further examples, the interleaf protective sheet can comprise a permanent coating that is attached to the glass sheet. For instance, the interleaf protective sheets can comprise permanent or semi-permanent coatings to the glass sheet and intended to remain attached during subsequent handling or processing steps. Moreover, while oversized interleaf protective sheets are shown, in further examples, undersized or size-matching interleaf sheets may be used in further examples. In such examples, a strap positioned over the stack may be used to help control relative lateral motion of the stack or glass sheets within the stack.

As shown in the figures, in further examples, none of the interleaf protective sheets 121 are adhered to any of the glass sheets 117. Providing interleaf protective sheets 121 that are not adhered to the glass sheets 117 can simplify assembly of the stack. Moreover, providing interleaf protective sheets 121 that do not adhere to the glass sheets 117 can simplify and reduce the costs when unpacking the glass sheets from the package 101. Indeed, not adhering the glass sheets 117 can avoid residual organic materials on the surface of the glass sheets that may require further processing (e.g., washing with detergent or the like) to remove residual organic material, fibers or other materials that may remain on the glass sheet after removing the interleaf protective sheet.

As shown in FIG. 1, each interleaf protective sheet 121 includes a sandwiched portion 121*a* engaging facing outer surfaces 117*a*, 117*b* of a corresponding pair of glass sheets 117 and an outer portion 121*b* that extends away from the sandwiched portion 121*a*. For example, as oriented in FIG. 1, the corresponding pair of glass sheets can comprise a lower glass sheet 117 and an upper glass sheet 117 positioned immediately above the lower glass sheet. The facing outer surfaces of the corresponding pair of glass sheets can comprise an upper surface (see 117*a*) of the lower glass sheet 117 and the lower surface (see 117*b*) of the upper glass sheet 117. These facing surfaces of the corresponding pair of adjacent glass sheets can be designed to provide direct pressure to sandwich the portion 121*a* of the interleaf protective sheet 121 positioned therebetween.

As further illustrated in FIG. 1, the outer portion 121*b* is not sandwiched between the facing outer surfaces and extends away from stacked array of glass sheets. Indeed, as shown, the outer portion 121*b* is a free standing portion that is cantilever supported by the sandwiched portion 121*a*. The free standing outer portion 121*b* is free to bend with respect to the sandwiched portion, and as shown, the outer portion 121*b* can be bent over a portion of the peripheral edge 119 of one of the corresponding adjacent pair of glass sheets 117 to discourage relative shifting of the glass sheets 117 with respect to one another. As shown, a bending crease 123 between the sandwiched portion 121*a* and the bent outer portion 121*b* can act as a shoulder to trap a corresponding corner of the peripheral edge 119. As will be appreciated, each one of the peripheral edges 119 can be provided with a corresponding outer portion 121*b* bent over the edge to help prevent lateral shifting of the glass sheets with respect to one another. As shown, the bending crease 123 comprises a relatively sharp bending crease although a more gradual curved bending crease may be provided in further examples.

It is also possible to provide the interleaf protective sheets without a bending crease. For instance, no bending crease may be provided in examples where the interleaf protective sheet comprises a protective coating to the glass sheet with minimum or no outer portion extending from the sandwiched portion. In further examples, no bending crease may be provided in examples where the interleaf protective sheet comprises an undersized or size-matching interleaf protective sheet with little or no outer portion extending from the sandwiched portion. In such examples, relative lateral shifting of the stack or the glass sheets relative to one another may be controlled by a strap overlying the stack similar or identical to the strap 131 discussed below.

As shown in FIGS. 2 and 6, examples are demonstrated wherein the plurality of glass sheets 205 extend along a curved plane. As shown in FIG. 2, the interleaf protective sheet can be continuous, as shown in FIG. 1 such that the interleaf engages the entire surface portion 117*a*, 117*b*. In alternative examples, as shown in FIG. 6, each interleaf protective sheet may optionally be not continuous. In such examples, the sandwiched portion of the interleaf can be designed to only extend between at least two edge portions. Indeed, due to the curved shape of the glass sheet, some shifting may be prevented by the curved nature of the glass sheets. As shown in FIG. 6, for example, the interleaf protective sheet 601 includes a sandwiched portion 601*a* and an outer portion 601*b* similar to the sandwich and outer portions 121*a*, 121*b* of the interleaf protective sheet 121 illustrated in FIG. 1. However, as shown, the interleaf protective sheet 601 is not continuous and only extends between two edge portions 605 of the outer surfaces 207*a*, 207*b*. As shown, the edge portions 605 comprise lateral edge portions that are substantially straight along the length "L" of the glass sheet 205. Although not shown, in further examples, the interleaf protective sheet 601 may only extend between the lateral edge portions 607 that are curved along the width "W" of the glass sheet 205. In still further examples, the interleaf protective sheet 601 may be non-continuous and extend between both pairs of lateral edge portions 605, 607 along the length "L" and the width "W". In such examples, the interleaf protective sheet 601 can be non-continuous in the central sandwiched portion.

Figure 3:
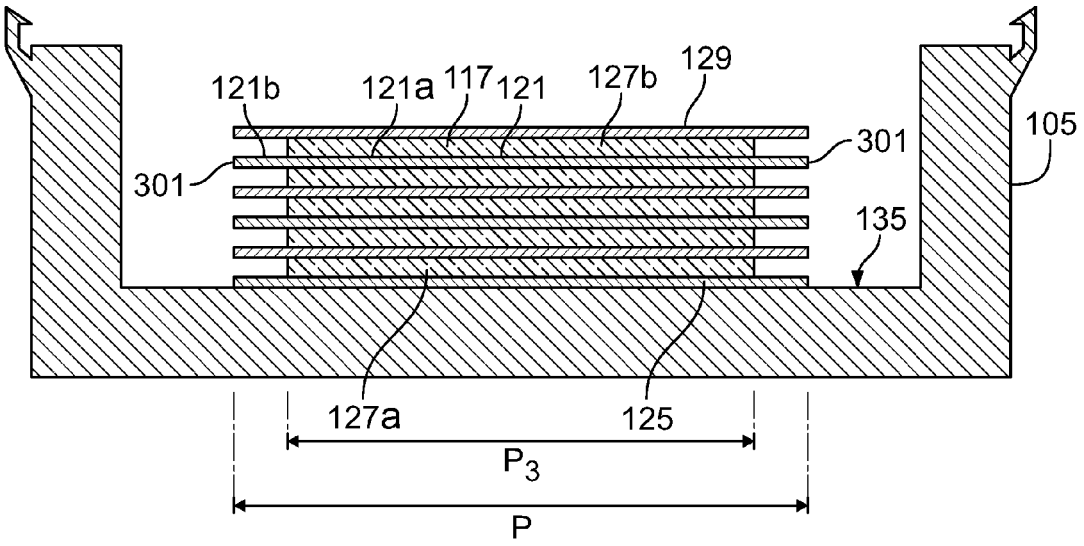
FIG. 3 is an example of a stack of glass sheets positioned with respect to a first pressure member of an outer housing of the package of FIG. 1.
Figure 4:
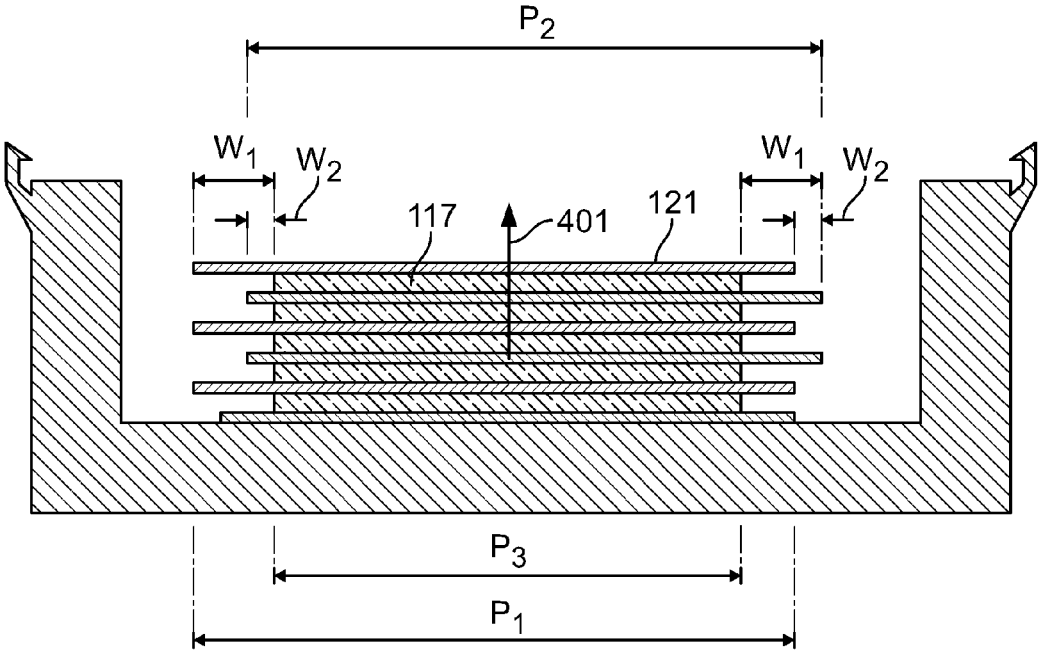
FIG. 4 is another example of a stack of glass sheets positioned with respect to a first pressure member.

As shown in FIG. 3, each of the interleaf protective sheets 121 can be aligned with one another such that the outer periphery 301 of the glass sheets 117 substantially along the same projected footprint "P". As shown in FIG. 4, the interleaf protective sheets 121 can be successively staggered with respect to one another in a direction 401 of the stack of glass sheets such that the outer portion of the interleaf protective sheets have alternating widths $W_1$, $W_2$ with respect to the corresponding peripheral edge 119 of the glass sheet 117. As such, the plurality of interleaf protective sheets 121 can comprise a first set of protective interleaf protective sheets having substantially the same protected first footprint "$P_1$" and a second set of protective interleave sheets having substantially the same protected second footprint "$P_2$", wherein the first projected footprint "$P_1$" is offset from the second projected footprint "$P_2$". Other staggering of the interleaf protective sheets 121 in a sequential pattern or more random variation is also possible in further examples. Staggering the interleaf protective sheets 121 may allow easier removal of the substrates from the package 101. In either case, the plurality of glass sheets 117 may be aligned with one another in a direction perpendicular to the outer surfaces of the glass sheets (e.g., the direction 401 of the stack of glass sheets). As such, in some examples the glass sheets 117 can have the same projected footprint "$P_3$". Providing the glass sheets 117 with the same projected footprint can help prevent stress on cantilevered portions of the glass sheets that may otherwise be present with sheets that are not aligned along the same projected footprint.

As shown in FIG. 1, an optional protective layer 125 can be provided between a first one 127*a* of a pair of outermost glass sheets 127*a*, 127*b* and the first pressure member 105 of the outer housing 103. Likewise, an optional outer protective sheet 129 can be positioned between a second one 127*b* of the pair of outermost glass sheets 127*a*, 127*b* and the second pressure member 107 of the outer housing 103. The protective layer 125 and/or the outer protective sheet 129, if provided, can be formed of a material similar or identical to the interleaf protective sheet 121 described above. Moreover, as shown, a first portion 129*a* of the outer protective sheet 129 engages the second outermost glass sheet 127*b* and an outer portion 129*b* of the outer protective sheet 129 may optionally be bent over a portion of the peripheral edge 119 of the second outermost glass sheet 127*b* to discourage a shifting movement of the second outermost glass sheet 127*b* within the stack 115 of glass sheets 117.

Referring back to FIG. 1, the package 101 can also include a strap 131 that, in some examples, bends the outer portion 121*b* of at least one or each interleaf protective sheet 121. In further examples, the strap 131 can be designed to inhibit lateral shifting of the stack 115 and/or glass sheets within the stack without bending the outer portion 121*b* of the interleaf protective sheets 121. As shown, the strap 131 can extend over the stack 115 of glass sheets 117. In further examples, the strap can be fixed to the first pressure member 105. As shown, the strap 131 can be fixed by way of adhesive tape 133 although other mechanical fixing techniques may be used such as glue, pins, staples or the like. The strap 131, if provided, can be formed from a wide range of materials. In one example, the strap 131 comprises a strip of material similar or identical in composition as the interleaf protective sheet 121.

As shown in FIG. 1, each pressure member 105, 107 applies a support pressure that is distributed over a corresponding one of the pair of outermost glass sheets 127*a*, 127*b* of the stack 115 of glass sheets 117. In some examples, the pressure is evenly distributed such that substantially the same pressure is applied to all portions of each glass sheet. Providing even pressure can avoid pressure differentials that may create undesired stress concentrations in the glass sheets. In order to achieve an even pressure differential, portions of the package 101 can include pressure surfaces that match the outer facing surfaces of the outermost glass sheets 127*a*, 127*b*. For example, in examples where the glass sheets 117 are flat, pressure surfaces 135, 137 may be substantially planar surfaces. As shown, for example, the first pressure surface 135 can comprise a substantially planar surface of the first pressure member 105. As shown in FIG. 2, in examples where the glass sheets 205 are curved, the first pressure surface 209 can have a curved shape to match the curved shape of the corresponding outermost glass sheet 211*a* of a pair of outermost glass sheets 211*a*, 211*b* of a stack 213 of glass sheets 205. As shown, for instance, the outwardly facing surface of the first outermost glass sheet 211*a* is concave; therefore, the first pressure surface 209 comprises a convex surface that matches the concave surface of the outermost glass sheet 211*a*.

As further illustrated in FIG. 1, the package 101 may optionally include a substantially rigid pressure plate 139 that is biased away from the second pressure member 107 of the outer housing 103 to apply support pressure distributed over the second outermost glass sheet 127*b*. In some examples, the pressure is evenly distributed such that substantially the same pressure is applied to all portions of each glass sheet. Providing even pressure can avoid pressure differentials that may create undesired stress concentrations in the glass sheets. In order to achieve an even pressure differential, the substantially rigid pressure plate 139 can be provided with the pressure surface 137. As shown, the pressure surface 137 is substantially flat to match the substantially flat configuration of the glass sheets 117. As shown in FIG. 2, in examples where the glass sheets 205 are curved, a substantially rigid pressure plate 215 can be provided with a second pressure surface 217 that has a curved shape to match the curved shape of the corresponding outermost glass sheet 211*b* of a pair of outermost glass sheets 211*a*, 211*b*. As shown, for instance, the outwardly facing surface of the second outermost glass sheet 211*b* is convex; therefore, the second pressure surface 217 comprises a concave surface that matches the convex surface of the outermost glass sheet 211*b*.

With respect to examples for substantially flat substrates, the rigid pressure plate 139, for example, can distribute pressure substantially evenly across the 2-dimensional surface of the glass sheets 117. With respect to examples with a curved glass sheet 205, as shown in FIG. 2, the rigid pressure plate 215 can either distribute pressure across the entire surface of the glass sheet 205 since the interleaf protective sheet illustrated in FIG. 2 comprises a continuous interleaf protective sheet. Alternatively, with respect to examples with a curved glass sheet 205 including non-continuous interleaf protective sheets 601 as shown in FIG. 6, the rigid pressure plate 215 can distribute the pressure evenly across only the surfaces of the glass sheet 205 engaging the non-continuous interleaf protective sheets.

The substantially rigid pressure plates 139, 215 may be biased away from the second pressure member 107 in a wide variety of ways. For example, as shown in FIG. 1, a spacer 141 can be provided to apply a biasing force to the substantially rigid pressure plates 139, 215. As shown, the spacer 141 can comprise a resilient member, such as a cloth, although elastomeric or other resilient materials may be used. In further examples, the spacer 141 may comprise a coil spring or other resilient member. Moreover, as shown, a single spacer 141 may be used although multiple spacers may be provided in accordance with further examples of the disclosure. The force is illustrated as being applied to a central portion of the substantially rigid pressure plates 139, 215. Due to the substantially rigid nature of the plates 139, 215, the compressive force is transmitted as an even bearing pressure across the corresponding outermost glass sheet.

As shown, once the stack 115 of glass sheets 117 are mounted within the package 101, the stack 115 can be arranged such that the outer housing 103 does not directly contact the peripheral edge 119 of any of the glass sheets 117. As such, the tensile stress at the peripheral edge 119 of the glass sheets 117 can be minimized, thereby avoiding undesired breakage of glass sheets within the package. In some examples, the glass sheets 117 are packaged such that a tensile stress at the peripheral edge is less than 200 MPa, such as less than 100 MPa, such as less than 50 MPa.

In further examples (e.g., see FIGS. 2 and 6), the glass stack can be assembled with a convex or concave shape. In these examples, the tensile stress each peripheral edge of the curved glass sheets can be maintained less than 200 MPa, such as less than 100 MPa, such as less than 50 MPa. It is also noted that the curved nature of the glass sheets 205 may be induced by the package. For example, the glass sheets 205 may be substantially planar glass sheets before packaging. Once engaging the concave and convex surfaces of the package, the glass sheets may be bent into the illustrated curved shape. Bending the sheets into the illustrated curved shapes can help prevent lateral shifting of the stack and/or glass sheets relative to one another. When unpackaged, the curved glass sheets may automatically flex back to the original flat configuration. In still further examples, the glass sheets may have a natural curved shape. In these examples, the concave and convex surfaces of the package can be designed correspond to the curved dimensions of the glass sheet.

A method of packaging a plurality of glass sheets will now be described with respect to the package 101 with the understanding that the method can be carried out substantially the same way with the package 201.

The glass sheets 117 and outer housing 103 can be provided. Thereafter, plurality of glass sheets can be stacked. In one example the stack can be formed first and then transferred to the outer housing. In another example, the stack can be formed directly on one of the pressure members of the housing. For instance, referring to FIG. 3, the optional protective layer 125 can first be positioned over the pressure surface 135 of the first pressure member 105. Next, the outermost glass sheet 127*a* is positioned over the protective layer 125. An interleaf protective sheet 121 is then positioned over the upper surface of the outermost glass sheet 127*a*. Glass sheets 117 and interleaf protective sheets 121 are then alternatively stacked to form the stack 115 of glass sheets 117. The various numbers of glass sheets may be stacked in the above manner. In one example, the stack 115 includes twenty glass sheets although more or less glass sheets may be stacked in further examples. The optional outer protective sheet 129 is then positioned over the outer facing surface of the second outermost glass sheet 127*b*.

Figure 5:
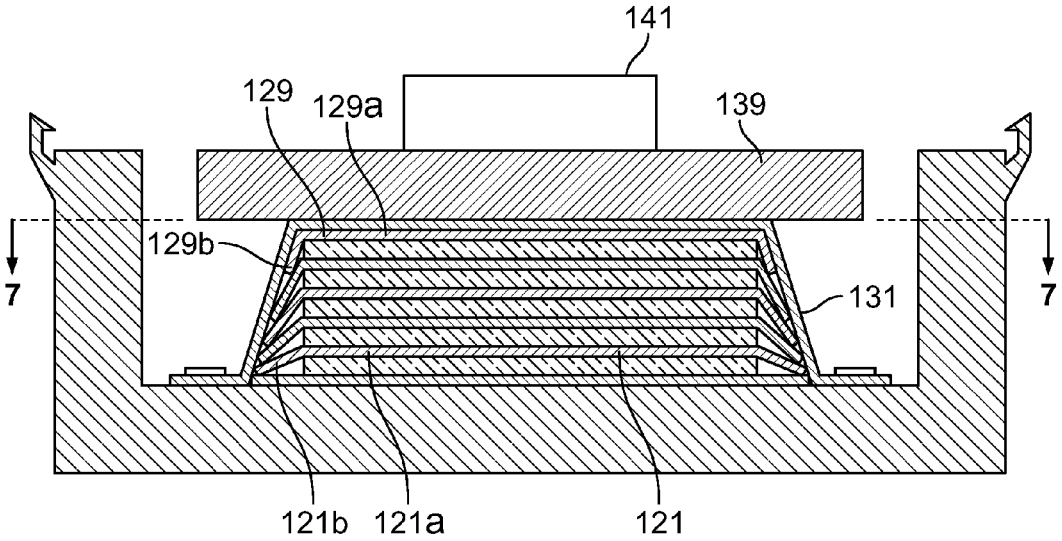
FIG. 5 is an example of the stack of FIG. 3 with a substantially rigid pressure plate and spacer positioned over the stack.

As shown in FIG. 5, the strap 131 can then be used to bend the outer portion 121*b* each interleaf protective sheet 121 and the outer portion 129*b* of the outer protective sheet 129. FIG. 7 is a cross section along line 7-7 of FIG. 5 and illustrates one example strap technique that may be used in examples of the disclosure. As shown in FIG. 7, the strap 131 comprises a first strap 701 extending over the stack 115 of glass sheets in the direction of the length "L" of the glass sheets 117. The first strap 701 is fastened with fasteners 703 to bend the outer portions of the outer protective sheet and interleaf protective sheets to extend over a portion of the opposed spaced apart pair of peripheral edges. Likewise, the strap 131 can comprise a second strap 705 extending over the stack 115 of glass sheets in the direction of the width "W" of the glass sheets 117. The second strap 705 is also fastened with fasteners 703 to bend the outer portions of the outer protective sheet and interleaf protective sheets to extend over a portion of another opposed pair of spaced apart peripheral edges.

As shown in FIG. 5, the substantially rigid pressure plate 139 can then be placed over the stack 115 of glass sheets 117. Next, the spacer 141 is placed over the substantially rigid pressure plate 139. As shown in FIG. 1, the second pressure member 107 can then be clamped down such that the biasing member 141 transmits a force to the substantially rigid pressure plate 139. A snapping connection 111 can maintain the pressure members 105 and 107 clamped together with the stack 115 sandwiched therebetween. The pressure members thereby increase the friction force of the interleaf protective sheets 121 to help prevent shifting of the glass sheets 117 within the outer housing 103. Likewise, the optional bent over outer portions 131*b*, 129*b* help further prevent shifting of the glass sheets relative to one another. Still further, as shown, the first and second pressure members 105, 107 can be designed to encapsulate an interior area 109 to protect the stack 115 of glass sheets 117 from external environmental conditions. Also, damage to the outer edges of the glass sheets can be avoided since the glass sheets are sandwiched between the pressure members of the outer housing such that the pressure members each apply a support pressure that is distributed over an outer surface of a corresponding one of the pair of outermost glass sheets of the stack of glass sheets. Moreover, tensile stress at the outer peripheral edges 119 can be reduced, thereby avoiding undesired breakage of the glass sheets.

It will be apparent to those skilled in the art that various modifications and variations can be made without departing from the spirit and scope of the claimed invention.

The invention claimed is:

1. A method of packaging a plurality of glass sheets comprising the steps of:

(I) providing a plurality of glass sheets that each includes a thickness defined between two opposed outer surfaces of the glass sheet, and at least one peripheral edge defining an outer periphery of the glass sheet;

(II) providing an outer housing including a first pressure member and a second pressure member;

(III) stacking the plurality of glass sheets with a plurality of interleaf protective sheets positioned between a plurality of adjacent pairs of glass sheets to form a stack of glass sheets; and (IV) sandwiching the stack of glass sheets between the pressure members of the outer housing such that the pressure members each applies a support pressure that is distributed over an outer surface of a corresponding one of the pair of outermost glass sheets of the stack of glass sheets so that each of the glass sheets extend along a curved plane, wherein the plurality of glass sheets are packaged such that a tensile stress at the peripheral edge is less than 200 MPa.

2. The method according to claim 1, wherein the first pressure member includes a curved surface.

3. The method according to claim 2, wherein the second pressure member includes a curved surface that is complementary to the curved surface of the first pressure member.

4. The method according to claim 1, wherein the thickness of each of the plurality of glass sheets is less than 300 μm.

5. The method according to claim 1, wherein during step (IV), the support pressure provided by each pressure member is substantially the same and uniform across the entire corresponding outer surface.

6. The method according to claim 1, wherein a plurality of the glass sheets bear a coating on at least one of the opposed outer surfaces, and at least some of the adjacent pairs of the glass sheets are stacked against each other with the coating located therebetween but without an interleaf protective sheet positioned therebetween.

7. The method according to claim 1, wherein each interleaf protective sheet includes a sandwiched portion engaging facing outer surfaces of the corresponding pair of glass sheets and an outer portion that extends away from the sandwiched portion, and wherein each interleaf protective sheet is not continuous with the sandwiched portion of each interleaf protective sheet only extending between at least two edge portions, or all of the edge portions of the facing outer surfaces.

8. The method according to claim 1, wherein the glass sheets are secured such that the outer periphery of the glass sheets are not subjected to a compressive stress exerted by the side walls of the housing.

9. The method according to claim 1, wherein the interleaf protective sheets are successively staggered with respect to one another in a direction of the stack of glass sheets such that the outer portion of the interleaf protective sheets have alternating widths with respect to the corresponding peripheral edge of the glass sheet.

10. A package comprising:

an outer housing including a first pressure member and a second pressure member;

a stack of glass sheets sandwiched between the pressure members, wherein each pressure member applies a support pressure that is distributed over a corresponding one of a pair of outermost glass sheets of the stack of glass sheets;

each glass sheet of the stack of glass sheets includes a thickness defined between two opposed outer surfaces of the glass sheet, and at least one peripheral edge defining an outer periphery of the glass sheet; and the stack of glass sheets includes a plurality of interleaf protective sheets positioned between a plurality of adjacent pairs of glass sheets in the stack, wherein each of the plurality of glass sheets extends along a curved plane, and wherein the plurality of glass sheets are packaged such that a tensile stress at the peripheral edge is less than 200 MPa.

11. The package according to claim 10, wherein the first pressure member includes a curved surface.

12. The method according to claim 11, wherein the second pressure member includes a curved surface that is complementary to the curved surface of the first pressure member.

13. The package according to claim 10, wherein the thickness of each of the plurality of glass sheets is less than 300 μm.

14. The package according to claim 10, wherein each of the plurality of glass sheets have substantially the same shape.

15. The package according to claim 14, wherein each interleaf protective sheet includes a sandwiched portion engaging facing outer surfaces of the corresponding pair of glass sheets and an outer portion that extends away from the sandwiched portion, and wherein each interleaf protective sheet is not continuous with the sandwiched portion of each interleaf protective sheet only extending between at least two edge portions, or all of the edge portions of the facing outer surfaces.

16. The package according to claim 10, wherein the outer housing does not directly contact the peripheral edge of any of the glass sheets.

17. The package according to claim 10, wherein a plurality of the glass sheets bear a coating on at least one of the opposed outer surfaces, and at least some of the adjacent pairs of the glass sheets are stacked against each other with the coating located therebetween but without an interleaf protective sheet positioned therebetween.

18. The package according to claim 10, wherein the interleaf protective sheets are successively staggered with respect to one another in a direction of the stack of glass sheets such that the outer portion of the interleaf protective sheets have alternating widths with respect to the corresponding peripheral edge of the glass sheet.

19. The package according to claim 10, wherein the support pressure provided by each pressure member is substantially the same and uniform across the entire corresponding outer surface.

* * * * *